US008224003B2

(12) United States Patent
Reithinger

(10) Patent No.: US 8,224,003 B2
(45) Date of Patent: Jul. 17, 2012

(54) HEARING APPARATUS USING AN INDUCTIVE SWITCHING CONTROLLER AS A RADIO TRANSMITTER

(75) Inventor: Jürgen Reithinger, Neunkirchen am Brand (DE)

(73) Assignee: Siemens Medical Instruments Pte. Ltd., Singapore (SG)

( * ) Notice: Subject to any disclaimer, the term of this patent is extended or adjusted under 35 U.S.C. 154(b) by 872 days.

(21) Appl. No.: 12/288,055

(22) Filed: Oct. 16, 2008

(65) Prior Publication Data

US 2009/0110221 A1 Apr. 30, 2009

Related U.S. Application Data

(60) Provisional application No. 60/982,769, filed on Oct. 26, 2007.

(30) Foreign Application Priority Data

Oct. 26, 2007 (DE) ..... 10 2007 051 307

(51) Int. Cl.
*H04R 25/00* (2006.01)

(52) U.S. Cl. ..... 381/312; 336/200; 336/232; 336/223; 336/226; 381/117

(58) Field of Classification Search ..... 381/312–331
See application file for complete search history.

(56) References Cited

U.S. PATENT DOCUMENTS

| | | | | |
|---|---|---|---|---|
| 7,151,430 | B2 * | 12/2006 | Mattsson | 336/232 |
| 7,206,426 | B1 * | 4/2007 | Julstrom et al. | 381/315 |
| 2004/0175009 | A1 * | 9/2004 | Niederdrank et al. | 381/315 |

FOREIGN PATENT DOCUMENTS

| | | | |
|---|---|---|---|
| DE | 102006024713 | B3 | 8/2007 |
| EP | 0473569 | A2 | 3/1992 |
| EP | 1045526 | A1 | 10/2000 |

* cited by examiner

*Primary Examiner* — David Vu
*Assistant Examiner* — Jonathan Han

(57) ABSTRACT

The installation size of hearing apparatuses and in particular of hearing devices is to be reduced. Provision is thus made for a hearing apparatus with a transmitting facility including an antenna for the wireless, electromagnetic transmission of data and a switching controller including an inductor, which is used to supply energy to the hearing apparatus and the transmitting facility, with the inductor of the switching controller being identical to the antenna of the transmitting facility. This multiple use of the inductor can save on installation space. In order to avoid mutual interference of the transmitting facility and the switching controller, the signals thereof are modulated independently of one another.

6 Claims, 2 Drawing Sheets

HEARING APPARATUS USING AN INDUCTIVE SWITCHING CONTROLLER AS A RADIO TRANSMITTER

CROSS REFERENCE TO RELATED APPLICATIONS

The present application claims the benefit of a provisional patent application filed on Oct. 26, 2007, and assigned application No. 60/982,769. The present application also claims the benefit of a German application No. 10 2007 051 307.2 filed Oct. 26, 2007. Both of the applications are incorporated by reference herein in their entirety.

FIELD OF THE INVENTION

The present invention relates to a hearing apparatus with a switching controller including an inductor and a transmitting facility including an antenna for the wireless, electromagnetic transmission of data. The term "hearing apparatus" is understood here to mean any sound-emitting device that can be worn in or on the ear, in particular a hearing device, a headset, receivers and the like.

BACKGROUND OF THE INVENTION

Hearing devices are wearable hearing apparatuses which are used to assist the hard-of-hearing. In order to accommodate numerous individual requirements, various types of hearing devices are available such as behind-the-ear (BTE) hearing devices, hearing device with external receiver (RIC: receiver in the canal) and in-the-ear (ITE) hearing devices, for example also concha hearing devices or completely-in-the-canal (ITE, CIC) hearing devices. The hearing devices listed as examples are worn on the outer ear or in the auditory canal. Bone conduction hearing aids, implantable or vibrotactile hearing aids are also available on the market. The damaged hearing is thus stimulated either mechanically or electrically.

The key components of hearing devices are principally an input converter, an amplifier and an output converter. The input converter is normally a receiving transducer e.g. a microphone and/or an electromagnetic receiver, e.g. an induction coil. The output converter is most frequently realized as an electroacoustic converter e.g. a miniature loudspeaker, or as an electromechanical converter e.g. a bone conduction hearing aid. The amplifier is usually integrated into a signal processing unit. This basic configuration is illustrated in FIG. 1 using the example of a behind-the-ear hearing device. One or a plurality of microphones 2 for recording ambient sound are built into a hearing device housing 1 to be worn behind the ear. A signal processing unit 3 which is also integrated into the hearing device housing 1 processes and amplifies the microphone signals. The output signal for the signal processing unit 3 is transmitted to a loudspeaker or receiver 4, which outputs an acoustic signal. Sound is transmitted through a sound tube, which is affixed in the auditory canal by means of an otoplastic, to the device wearer's eardrum. Power for the hearing device and in particular for the signal processing unit 3 is supplied by means of a battery 5 which is also integrated in the hearing device housing 1.

Once a technology based on lithium is to be used in a hearing device as an energy source, the cell voltage which is high in comparison with alkali-manganese batteries or zinc-air batteries for instance is to be reduced, if further use is to be made of the technology designed for 1.5 volts. This technology, which is as a rule currently used, is designed for voltages below 1.5 volts for energy saving reasons. Lithium batteries nevertheless provide 3.0 volts and lithium rechargeable batteries even provide a nominal 3.6 volts up to a maximum 4.2 volts.

One efficient method of decreasing the cell voltage to the desired operating voltage, without as a result losing large quantities of energy, consists in the use of a switching controller. Modern hearing systems are in many cases also equipped with radio systems, in order to transmit data wirelessly. One combination of these two technologies now leads to the problem that electromagnetic losses in the switching controller result in interferences in the radio system. In particular, interferences in the range of the fundamental frequency and all multiples of the signal of the switching controller ensue.

Lithium energy sources were previously hardly used for hearing apparatuses. The problem of interferences in a radio system as a result of the switching controller thus practically never occurred in hearing apparatuses. As a result of the demand for rechargeable batteries, more and more lithium systems will however be used in the future.

With hearing apparatuses and in particular with hearing devices, there is generally the desire to reduce the installation size. To this end, the quest to provide as many functions in a hearing apparatus as possible and/or to want to use an energy source which allows for an increased energy transfer, is counterproductive here.

SUMMARY OF THE INVENTION

The object of the present invention thus consists in reducing the installation size of a hearing apparatus, which has a transmitting facility and a power supply with a voltage controller.

This object is achieved in accordance with the invention by a hearing apparatus with a transmitting facility including an antenna for the wireless, electromagnetic transmission of data, and a switching controller, including an inductor, which is used for supplying energy to the hearing apparatus and the transmitting facility, with the inductor of the switching controller being identical to the antenna of the transmitting facility.

It is thus advantageously possible to simultaneously use a component of the power supply, namely the inductor of the switching controller, for the data transmission of a transmitting facility. At least one component can thus be spared and the installation space of the hearing apparatus can consequently be reduced.

According to a special exemplary embodiment, the inductor can comprise a partially open ring core. As the ring core is not completely closed, the magnetic flow is not entirely directed in the ring core and can be used for electromagnetic data transmission purposes.

One alternative embodiment consists in the inductor having a cross-sectionally 8-shaped open core on one or two sides. The one or the several openings is also used here to targetedly effect electromagnetic radiations, in order to realize data transmission.

To ensure that the transmitting facility and the switching controller, which together use an inductor, do not interfere with one another, it is favorable for the fundamental frequency and the base phase of the signal of the switching controller to remain essentially unchanged during the control process, while they or one of them is/are changed in the signal of the transmitting facility for data transmission purposes. The energy transmission and the data transmission thus barely influence one another.

Pulse width module, pulse density modulation or amplitude modulation is preferably used in the switching controller for energy transmission purposes. These types of modulation are characterized in that they, as mentioned above, barely influence the fundamental frequency and the base phase of the signal of the switching controller.

The use of the frequency or phase modulation in the transmitting facility for data transmission purposes is also advantageous. These types of modulation allow an efficient data transmission to be effected, if during the energy transmission, a change in the base frequency and base phase of the signal is ignored.

A further advantageous embodiment consists in a supplementary inductor with a closed core being attached to the inductor in a connectable fashion. The magnetic circuit in the core is thus closed in the supplementary inductor, so that electromagnetic radiations are avoided as far as possible. By connecting this supplementary inductor, the energy transmission over the switching controller can be increased without increasing the transmission power.

BRIEF DESCRIPTION OF THE DRAWINGS

The present invention is described in more detail with reference to the appended drawings, in which.

DETAILED DESCRIPTION OF THE INVENTION

The exemplary embodiments illustrated in more detail below represent preferred embodiments of the present invention.

Figure 1:
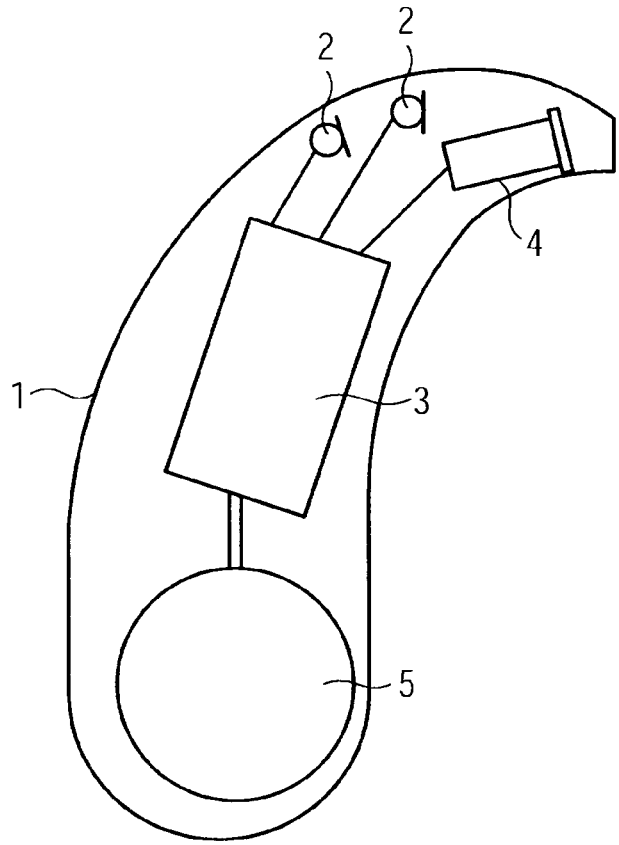
FIG 1 Prior art
FIG. 1 shows a main circuit diagram of the design of a hearing device according to the prior art.
Figure 2:
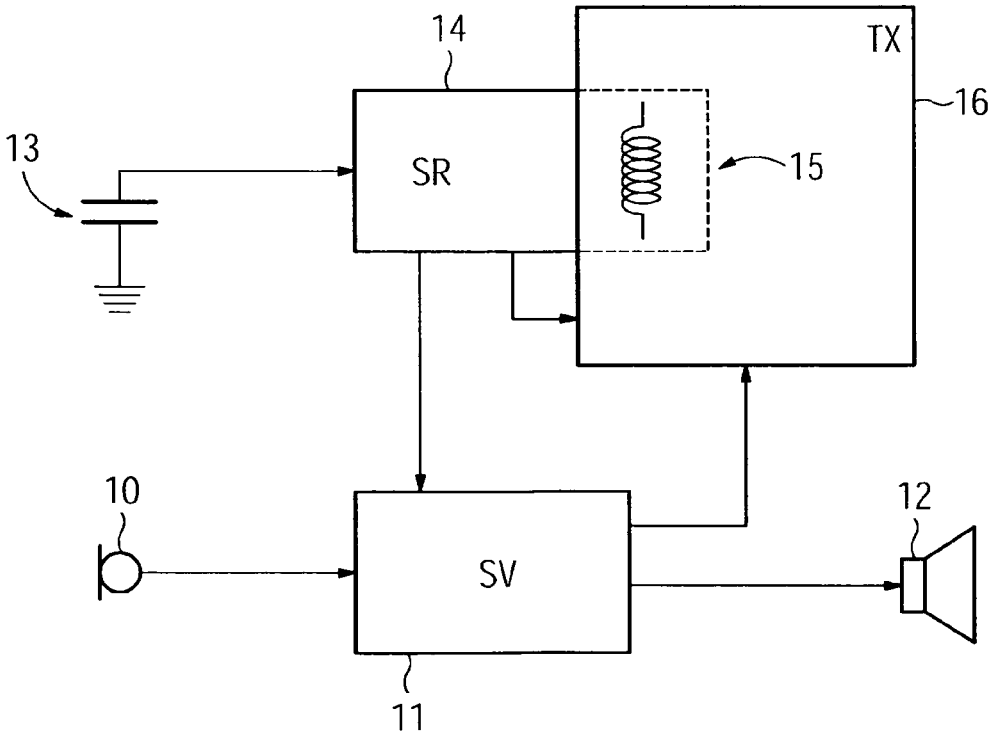
FIG. 2 shows a main circuit diagram of an inventive hearing device.

According to the example in FIG. 2, the hearing apparatus, here a hearing device, has an input converter, in the present instance a microphone 10. The microphone signal is fed to a signal processing unit 11, which in turn transmits an output signal to a receiver and/or loudspeaker 12. For power supply purposes, the signal processing facility 11 has a battery 13 with a switching controller 14 arranged downstream thereof. The switching controller 14 transforms the voltage supplied by the battery 13 to the desired operating voltage. If a lithium battery of 3 volts is used for instance, the voltage is reduced to below 1.5 volts for instance with the aid of the switching controller 14. Instead of the battery 13, a rechargeable battery, e.g. a lithium rechargeable battery with a nominal 3.8 volts can also be used as an energy source. The voltage controller 14 then controls the rechargeable voltage of 3.8 volts to a 1.2 volt operating voltage for instance.

The switching controller 14 is an inductive switching controller, which has an inductor 15 for controlling the voltage. The inductor is used to smooth the output voltage during switching processes.

The hearing apparatus in FIG. 2 also has a transmitter 16, which uses the inductor 15 as an antenna. The inductor 15 is thus both part of the switching controller 14 as well as the transmitter 16, which is indicated in FIG. 2 by the dashed line. The inductor 15 thus has a dual functionality. The transmitter 16 is powered like the signal processing unit 11 by way of the switching controller 14. The transmitter 16 receives the data to be transmitted from the signal processing unit 11.

In accordance with the invention, one single inductor 15 is thus used simultaneously for the switching controller 14 and the transmitter 16, as a result of which an inductor, which knowingly requires a large amount of installation space, can be spared. To ensure that the inductor can also be used as a transmitter and/or transmitting antenna, it must be able to radiate at least one part of the magnetic energy. This can be achieved for instance by an inductor, which does not have a closed ring core for instance but instead a more or less large air gap in the ring.

Figure 3:
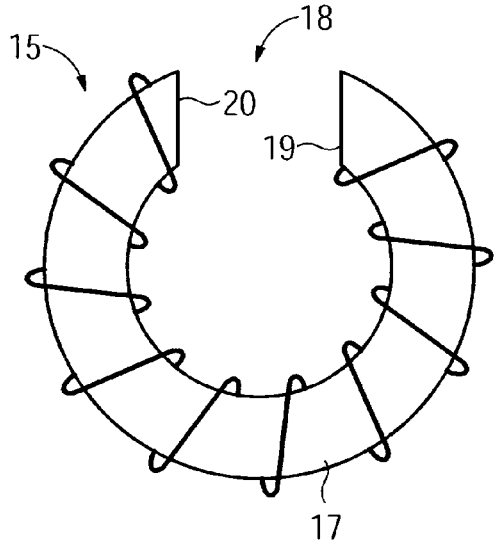
FIG. 3 shows an inductor according to a first embodiment of the present invention.

A first exemplary embodiment of such an inductor which is used in accordance with the invention is reproduced in a plan view in FIG. 3. Here the inductor 15 has a ring core 17 with a small gap 18. The front surfaces 19, 20 of the gap 18 face one another so that the magnetic field lines only stick out slightly from the gap. Only a weakly radiating antenna can then be realized with this ring core geometry.

Figure 4:
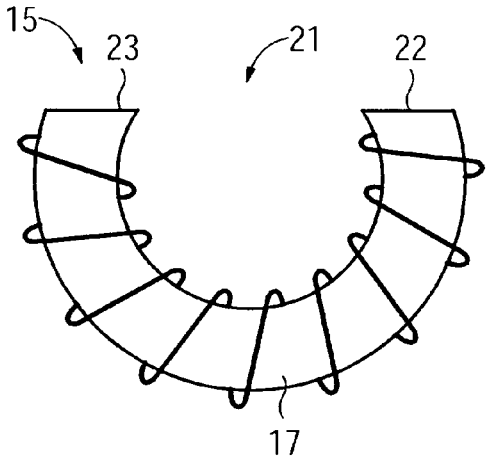
FIG. 4 shows an inductor according to a second embodiment.

If by contrast a high transmission power of the transmitter installed in the hearing apparatus is desired, a more powerfully radiating antenna must be used. One example of this is shown in FIG. 4. This in turn concerns an inductor 15 with a ring core 17. The ring core 17 here has a large gap 21, with the front faces 22, 23 of the open ring core 17 not being aligned to one another. This geometry gives rise to a completely different radiation characteristic than in the example in FIG. 3. In particular, the magnetic field lines pass far out of the gap 21, as a result of which a stronger radiation results.

Any inductor can essentially be used as an antenna, the core of which does not form a closed magnetic circuit. If the core is namely closed, as mentioned, only a minuscule part of the magnetic flow is directed outside the core, which is unsuitable for an electromagnetic transmitter. The geometry of the core of the inductor 15 is thus to be optimized in respect of the radiation characteristics, with a compromise having to be found in respect of the least possible energy loss for the function of the switching controller. A linear dipole would however be optimum for the transmitter, but unsuitable for the switching controller, since it radiates virtually all the energy.

Figure 5:
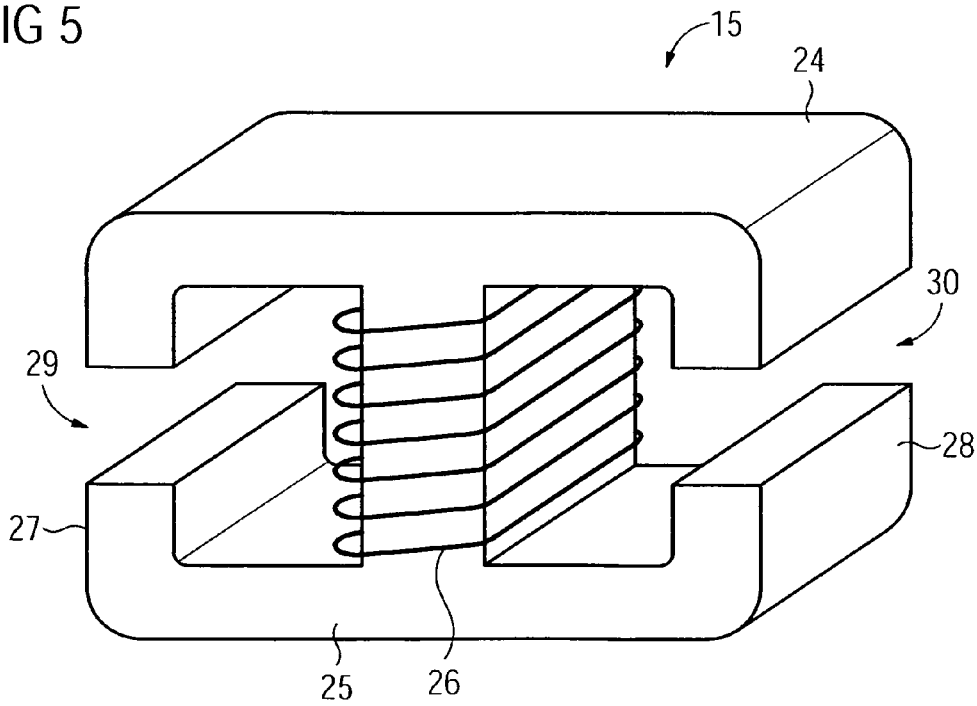
FIG. 5 shows an inductor according to a third embodiment.

A third exemplary embodiment of an inductor for the common use of a switching controller 14 and a transmitter 16 is shown in FIG. 5. Here the core 24 has a cross-section with essentially the shape of an "8". A coil 26 is wound around the center bar 25. The center bar 25 is closed, whereas the two outer bars 27 and 28 each have a gap 29 and/or 30. These two gaps 29, 30 provide again for the desired electromagnetic radiation. The design of the inductor 15 is suited in particular to SMD components, since these can be realized to be very flat.

So that the switching controller 14 and the transmitter 16, which use the common inductor 15, do not interfere with one another, the switching controller controls the output voltage by means of pulse width modulation for instance, without as a result changing the base frequency or the base phase of the signal. The base frequency can thus be changed and/or the base phase displaced in order to transmit data with the aid of the transmitter 16. This can be realized with the aid of conventional modulators (e.g. HM modulator or PM modulator). The pulse width modulation of the switching controller can also be realized independently of the modulations of the data transmission by means of conventional circuits.

A changing load of the switching controller 14 would naturally change the transmitting energy accordingly as a result of the common use of the inductor 15. However, the transmission energy can be attuned to a system and its expected load, by the radiated power and the short-circuited power being attuned to one another by means of the geometry of the antenna and/or inductor.

If the minimum and maximum power consumption of the system lie in a range in which the minimum power output resulting therefrom is still sufficient for the radio transmission and the maximum power still lies within the permissible scope, further measures are then unnecessary for the transmission power adjustment. On the other hand, a connectable additional inductor would be used, which would further increase the converter power without further increasing the transmission power accordingly. The connectable additional inductor would have the sole function of energy transmission, but not the function of data transmission. The energy transmission can thus be increased without increasing the radiation.

The inventive multiple usage of an inductor for the switching controller and transmitter introduces numerous advantages. If two external inductors are needed in the case of a conventional design of a hearing device outside the amplifying chip, with the solution shown here, only one active external component, namely only the one inductor outside the chip, is necessary. This is hugely advantageous in the respect of installation space.

By using the invention, high voltage batteries or rechargeable batteries can be operated in current conventional circuits for hearing devices and the power density of these energy sources would be available and not only the current density thereof. The independent modulation between the switching controller and the transmitter produces further advantages in respect of the virtually interference-free radio transmission, with losses of the switching controller being used, at least in part, beneficially as transmission energy. For bidirectional connections, two different frequencies can be used for instance, since with this realization the transmitter would always operate and no reception would thus be possible on the same frequency.

Since relatively high frequencies are needed for an efficient voltage control and for small components, transmissions with comparatively high data rates could thus take place. Audio data connections between the hearing devices with a maintainable energy consumption would thus be possible for instance (Cross-devices und suchlike).

The invention claimed is:

1. A hearing apparatus, comprising:

a transmitting unit comprising an antenna that wirelessly and electromagnetically transmits data; and a switching controller comprising an inductor that supplies energy to the hearing apparatus and the transmitting unit, wherein the inductor is configured to be identical to the antenna, wherein a base frequency and a base phase of a signal of the switching controller essentially remains unchanged during a control process for transmitting the energy, wherein the inductor comprises one single partially open ring core, or wherein the inductor comprises a cross-sectionally 8-shaped open core, wherein the 8-shaped open core is wound around a center bar that is closed, and wherein the 8-shaped open core comprises two outer bars each having a gap.

2. The hearing apparatus as claimed in claim 1, wherein a base frequency or a base phase of a signal of the transmitting unit is changed during a control process for transmitting the data.

3. The hearing apparatus as claimed in claim 1, wherein the switching controller transmits the energy using a modulation selected from the group consisting of: a pulse width modulation, a pulse density modulation, and an amplitude modulation.

4. The hearing apparatus as claimed in claim 1, wherein the transmitting unit transmits the data using a frequency modulation or a phase modulation.

5. The hearing apparatus as claimed in claim 1, wherein a supplementary inductor comprising a closed core is attached to the inductor.

6. A method for reducing an installation size of a hearing apparatus, comprising:

transmitting data by a transmitting unit of the hearing apparatus comprising an antenna; and supplying energy to the hearing apparatus and the transmitting unit by a switching controller of the hearing apparatus comprising an inductor identical to the antenna, wherein a base frequency and a base phase of a signal of the switching controller essentially remains unchanged during a control process for transmitting the energy, wherein the inductor comprises one single partially open ring core, or wherein the inductor comprises a cross-sectionally 8-shaped open core, wherein the 8-shaped open core is wound around a center bar that is closed, and wherein the 8-shaped open core comprises two outer bars each having a gap.

* * * * *